United States Patent [19]

Conn

[11] Patent Number: 4,813,787

[45] Date of Patent: Mar. 21, 1989

[54] BLENDING APPARATUS

[76] Inventor: Leroy C. Conn, 770 Hatch Run Rd., Warren, Pa. 16365

[21] Appl. No.: 76,853

[22] Filed: Jul. 23, 1987

[51] Int. Cl.[4] ..... B01F 7/10; B01F 7/26

[52] U.S. Cl. ..... 366/296; 366/293; 366/316; 366/317; 416/181; 416/199; 416/227 R

[58] Field of Search ..... 366/315–317, 366/292–296, 176, 181, 290, 279, 342, 343; 241/46 R, 46.17; 416/76, 181, 199, 231 R, 227 R

[56] References Cited

U.S. PATENT DOCUMENTS

| | | | |
|---|---|---|---|
| 1,304,349 | 5/1919 | Moore et al. . | |
| 1,516,792 | 11/1924 | Ruggles . | |
| 1,582,518 | 4/1926 | Horrell . | |
| 1,616,817 | 2/1927 | Maxwell . | |
| 1,655,447 | 1/1928 | Wait . | |
| 2,035,333 | 3/1936 | Mills . | |
| 2,544,374 | 3/1951 | Wotring . | |
| 2,692,127 | 10/1954 | Conn . | |
| 2,918,264 | 12/1959 | Ackles . | |
| 3,030,083 | 4/1962 | Stiffler . | |
| 3,215,409 | 11/1965 | Porciello . | |
| 3,376,024 | 4/1968 | Beechler et al. . | |
| 3,402,897 | 9/1968 | Willems | 241/46 |
| 3,462,131 | 8/1969 | Hill . | |
| 3,606,577 | 9/1971 | Conn | 416/181 |
| 4,475,820 | 10/1984 | Mulligan | 366/296 X |

FOREIGN PATENT DOCUMENTS

| | | | |
|---|---|---|---|
| 1186031 | 1/1965 | Fed. Rep. of Germany | 416/183 |
| 1297805 | 5/1962 | France | 416/183 |
| 1482898 | 4/1967 | France | 416/183 |

*Primary Examiner*—Timothy F. Simone

*Attorney, Agent, or Firm*—Fisher, Christen & Sabol

[57] ABSTRACT

A blending apparatus has a rotor provided with louvers and mixing teeth. The louvers have openings which vary in size and act to convey materials being cut and blended through the disc. The mixing teeth extend from peripheral edges of the rotor. Adjacent teeth vary in angular extension from the edges and in direction of extension from the edges. One or more rotors may be mounted on one or more shafts to meet diverse mixing needs.

18 Claims, 2 Drawing Sheets

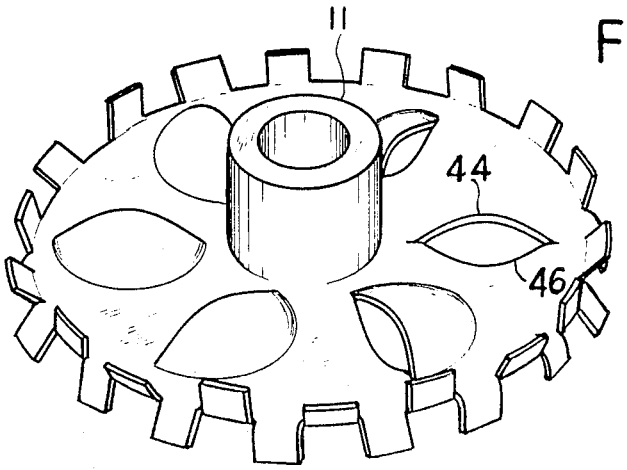
FIG. 4
FIG. 5
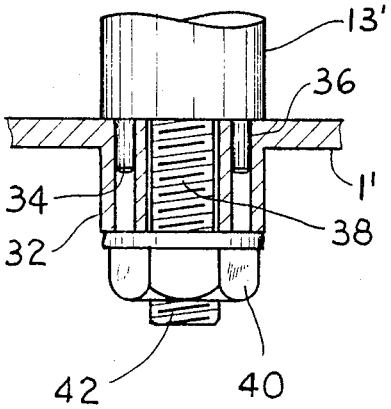
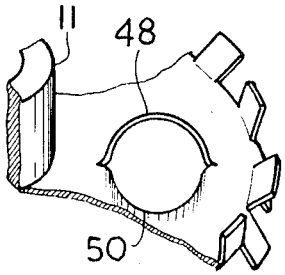
FIG. 4A
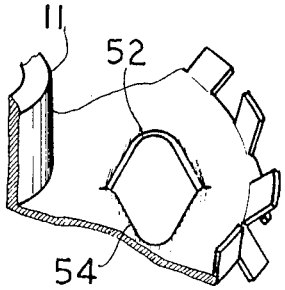
FIG. 4B
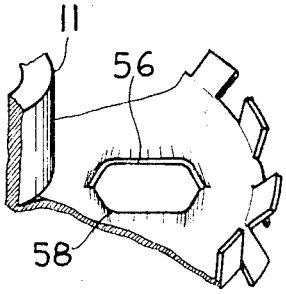
FIG. 4C

BLENDING APPARATUS

BACKGROUND OF THE INVENTION

The invention relates to fluid reaction surfaces such as impellers and the like. More in particular, the invention relates to rotors having flow confining or deflecting webs, shrouds or continuous passages. Material blenders are exemplified by such devices as U.S. Pat. No. 2,692,127 to Conn. Conn discloses an improved blender comprising a spindle carrying adjacent one end an outwardly extending annular disc. The disc has circumferentially spaced openings extending therethrough wherein material deflecting hoods carried by the disc extend across the openings for directing material through the openings from one side of the disc to the other. Deflectors are carried by the disc and extend outwardly from the side thereof remote from the hoods in advance of the openings.

Another example of a blending apparatus is U.S. Pat. No. 3,606,577 to Conn. In this patent, Conn discloses peripheral teeth which alternate in an up-and-down pattern. As a group, the teeth may be inclined relative to the plane of the disc at angles varying over a wide range. Thus, in FIG. 4 of U.S. Pat. No. 3,606,577, mixing teeth are disclosed which angle at an inclination to the plane of the disc approximately 45 degrees.

While the apparatus of Conn provides certain degrees of mixing, cutting and masticating, there is room for improvement such that mixing and blending can be effected more efficiently with less energy expense. Therefore it is an object of this invention to provide an apparatus which blends, mixes and masticates material more efficiently than the prior art devices. It is another object of the invention to provide a rotor disc having mixing teeth located on peripheral edges which not only alternate in up-and-down patterns and vary in angular inclination to the plane of the disc over a range of degrees, but which provides mixing teeth which vary one from another in angular inclinations to the plane of the disc such that mixing, masticating and blending occur more rapidly and in a less regular fashion.

It is still another object of the invention to provide a disc which presents an irregular cutting pattern and irregular transmitting of materials through the openings such that more efficient mixing, blending and cutting occur.

It is yet another object of the invention to provide an apparatus having one or more stirrers mounted on one or more shafts to provide different mixing patterns and degrees of mixing.

It is still yet another object of the invention to provide stirrers that may be left- and right-handed to increase mixing and mastication.

These and other further objects and features of the invention are apparent in the disclosure, which includes the foregoing and following specification, claims and drawings.

SUMMARY OF THE INVENTION

The invention is a material mixing apparatus comprising a stirrer fixedly mounted on a shaft for mixing and masticating material. More than one stirrer may be assembled on more than one shaft to provide different mixing patterns and degrees of mixing. The stirrer is preferred to be a round, flat disc provided with attachment means for mounting on a shaft. The disc has openings which are slot-like and which are circumferentially spaced about the disc. The openings are radially aligned and preferably varied in size and shapes depending upon the mixing and masticating needs of a particular situation. Each opening has first and second edges which oppositely extend from the surface of the disc for conveying materials through said openings. That is to say, one side of the opening will extend outwardly from the disc and the other side of the opening will extend outwardly, yet in an opposite direction. The edges of the openings extend in a direction which is perpendicular to the plane of the disc.

Preferably, the length of extensions of the edges outwardly from the disc may vary. Also, the length of the openings may vary. For example, the slot-like openings may extend one-quarter of a radius of the disc to about 100 percent of said radius.

Mixing teeth are located along and extend from the peripheral edge of the disc. The teeth may alternate in direction of extension from the plane of the disc. That is to say, adjacent teeth will extend generally in opposite directions from each other. It is preferred that the teeth be varied in angular inclinations to the plane of the disc. The range of inclinations preferably being 0 degrees to about 90 degrees. Thus, one particular tooth will extend at a 90-degree angle to the plane of the disc and an adjacent tooth will extend in an opposite direction at a 45-degree angle to the disc, and a third tooth may extend in an opposite direction relative to the second tooth (i.e., in the same general direction relative to the plane of the disc as the first tooth) at a 60-degree angle to the plane of the disc, and so forth.

The discs are mounted on rotatable shafts in a fixed fashion. Preferably a set screw threadably received in a channel in the hub allows the set screw to press against a surface of the rotatable shaft for rigidly maintaining the hub in fixed relation thereto. Alternatively, the disc can be secured to an end of a shaft by means of driving pins extending between the end of the shaft and through the disc for retaining the disc as rotatable in relation to the shaft. A bolt and an optional bushing plate is used for removable fixed attachment of the disc to the shaft. Thus, when the shaft is rotated the disc or stirrer is rotated therewith. The shaft may be rotated and controlled in the rotation by any suitable means such as an electric motor equipped with a rheostat.

When one stirrer is mounted on a shaft and used for mixing or blending materials, the stirrer will cause the material being cut and blended to travel through the openings. A horizontally oriented stirrer or disc will have openings wherein one side of the opening is depressed downwardly and the other side of the opening is projected upwardly such that material being mixed moves along the depressed surface towards the upwardly projecting surface. As material moves into the opening it further follows the underside of the upwardly projecting surface downwardly and outwardly towards the mixing teeth. The mixing teeth then catch the downwardly and outwardly moving material to further cut, masticate and mix the material.

The invention provides for increased mixing of material by placing two stirrers on one shaft in an opposed mutually spaced relationship wherein a mixing space between the stirrers is provided. It is preferred that the two discs be left-handed and right-handed or one reversed from the other. The opposed relation of the multiple discs is to provide for the transmission of materials through the openings into the space located between the stirrers wherein material being blended is forced into the space and out towards the mixing and cutting teeth.

The invention provides for mounting of opposed stirrers on contrarotating shafts which are juxtaposed end to end, wherein one stirrer is right-handed and the other stirrer is left-handed such that the direction of transmitting material through the openings is different from one disc to the other.

BRIEF DESCRIPTION OF THE DRAWINGS

While the specification concludes with claims particularly pointing out and distinctly claiming the subject matter that is regarded as forming the present invention, it is believed that the invention will be better understood from the following description accompanied by the following drawings in which:

FIG. 4 is a partial elevated perspective showing one embodiment of the louvers according to the invention;

FIGS. 4*a*–4*c* are partial elevated perspectives showing alternate embodiments of the louvers of figure 4; and FIG. 5 is side plan view in partial cutaway of one of the attachment means according to the invention.

DESCRIPTION OF THE PREFERRED EMBODIMENTS

Figure 1:
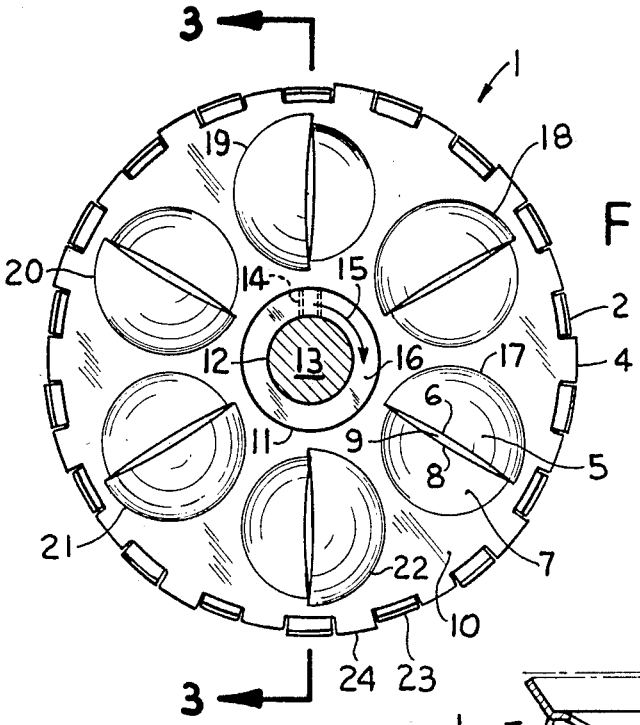
FIG. 1 is a top plan view of one embodiment of the stirrer according to the invention.

Referring to FIG. 1, a cutting blade generally designated 1 is shown. The blade 1 is flat and round and has a hub 16 for mounting on a shaft 13. The hub 16 has outer wall 11 and inner wall 12. Inner wall 12 defines a channel through the disc 1 wherein shaft 13 is received.

The surface 10 has located thereon circumferentially spaced and radially aligned openings 9. Each opening 9 is provided with a first edge 8 and a second edge 6. Edges 6 and 8 extend in opposite directions from the surface 10 such that there is a raised portion 5 and depressed portion 7. The structure 5, 6, 7, 8 and 9 is generally referred to as a louver. Thus, the disc 1 is provided with louvers 17, 18, 19, 20, 21 and 22 on the surface 10. It should be noted that other numbers of louvers can be used.

Figure 2:
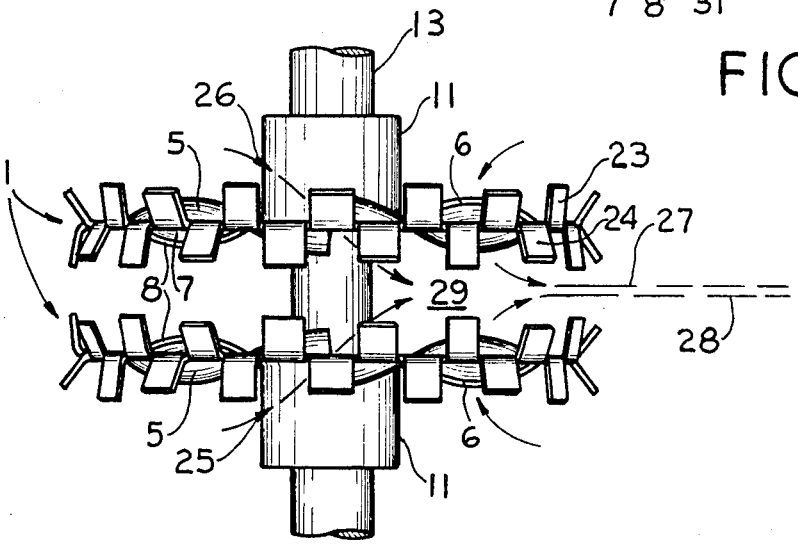
FIG. 2 is a side plan view of two stirrers as shown in FIG. 1 mounted on a shaft.

On the peripheral edges of disc 1 there is located mixing teeth 23 and 24. The mixing teeth are located along the circumferential periphery of disc 1. For purposes of discussion, only two teeth in FIG. 1 will be described. Mixing tooth 23 extends in a direction similar to the raised surface 5 and tooth 24 extends in a direction similar to that of depressed surface 7. Referring to FIG. 2, there is shown two discs which are both generally designated as 1 mounted on shaft 13 in an opposed and mutually spaced relationship such that space 29 is defined therebetween. Arrow 15 in FIG. 1 defines the rotation of shaft 13. As shaft 13 rotates, material which is being blended is drawn through the openings in the direction of arrows 25 and 26. Material that has been drawn into space 29 is urged outwardly towards the periphery of the discs 1 and is further blended and cut by the teeth 23 and 24. Material being cut by the teeth is urged in the direction of arrows 27 and 28.

Figure 3:
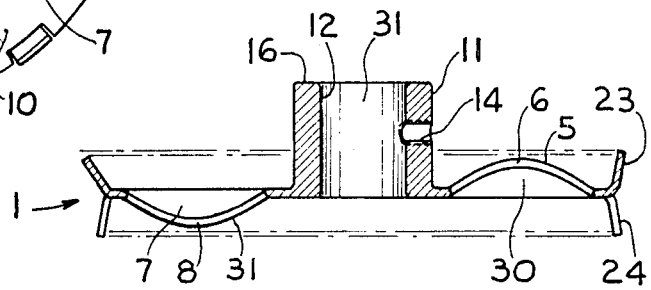
FIG. 3 is a cross section taken along line 3—3 of FIG. 1.

Referring to FIG. 3, the disc 1 is shown in cross section. Hub 16 is centrally located on the disc 1. Inner wall 12 of hub 16 defines a cylindrical channel 31 which is adapted to slidably receive rotatable shaft 13 as depicted in FIGS. 1 and 2. The disc 1 is fixedly mounted on shaft 13 by way of a set screw (not shown) being inserted in channel 14. Channel 14 is preferably lined with threads and is adapted to threadably engage a set screw which presses against surfaces of the shaft 13.

The oppositely extending edges 6 and 8 are shown more clearly in FIG. 3. Opening edge 6 extends upwardly and opening edge 8 extends downwardly as shown in the embodiment of FIG. 3. Thus, upwardly extending edge 6 has an associated concave surface 30 located on a lower surface of the disc 1 and convex surface 5 located on an upper surface of disc 1. Similarly, downwardly extending opening edge 8 has associated concave surface 7 located on an upper face of disc 1 and a convex surface 31 located on a lower surface of disc 1. As should be readily apparent, the louver on disc 1 comprises opening edges 6 and 8, concave surfaces 7 and 30, convex surfaces 5 and 31, and opening 9.

FIG. 4 shows the louvers of the invention in perspective. As shown, the louvers are ovoid holes in radial extension between the central disc area and the periphery. The holes have raised portion 44 and depressed portion 46. It should be noted that portions 44 and 46 can vary in degree of extension. For example, figure 4a shows raised portion 48 and depressed portion 50 forming a more open and less ovoid opening. FIG. 4b shows a still wider opening with raised portion 52 and depressed portion 54 forming an almost diamond shaped opening. FIG. 4c shows a slight variation wherein raised portion 56 and depressed portion 58 are flat sided at the most extended areas. As was noted above, any number of louvers may be positioned about the circumference of the disc depending upon the job at hand. Additionally, the louvers may vary in opening sizes either from disc to disc or from louver to louver upon a disc.

Referring to FIG. 5, an alternate method of attachment is shown. The shaft 13′ is shown with driving pins 34 and 36 extending between the end of the shaft 13′ and the disc 1′. Holes are located on the disc 1′ for receiving the driving pins 34 and 36. As shown, a bushing 32 can be used in conjunction with a threaded lug 42 and nut 40 to removably attach disc 1′ to the central shaft 13′.

In operation, the apparatus of FIG. 2 is rotated clockwise in an area containing unblended materials. Stirrers may be made opposite hand so that the shaft may be rotated counter-clockwise if necessary. Opening edge 6 captures material and conveys the material inwardly towards the space between the discs along concave surface 30. The associated depressed surface 7 serves to help direct material towards surface 30. Material moves inwardly in the direction of arrows 25 and 26 and outwardly towards mixing teeth 23 and 24. Arrows 27 and 28 depict the movement of materials around the teeth. The irregularity of the angular inclination of teeth ensures a variety of cutting edges in contact with the material such that effective cutting and mixing occur. The irregular cutting pattern which results from the variety of angular orientations at which the two groups of teeth (i.e., those which point either upwardly or downwardly from the plane of the disc 1) are inclined relative to the plane of the disc 1 provides superior mixing by mixing an entire three-dimensional "zone" of material rather than merely a two-dimensional "plane" of material as is the case with other devices.

As this invention may be embodied in several forms without departing from the spirit or essential characteristics thereof, the present embodiment is therefore illustrative and not restrictive, and since the scope of the invention is defined by the appended claims, all changes that fall within the metes and bounds of the claims or that form their functional as well as their conjointly cooperative equivalents are therefore intended to be embraced by those claims.

What I claim is:

1. A material mixing apparatus mountable on a rotatable shaft, comprising:

(a) a disc having attachment means for fixed mounting on said shaft;

(b) plural circumferentially spaced and radially aligned openings located on a surface of said disc and extending therethrough, wherein each opening has first and second edges oppositely extending from said surface for conveying materials through said openings when said disc is rotated;

(c) mixing teeth located along and extending in opposite directions, alternately both upwardly and downwardly from the peripheral edges of said disc, said teeth being angularly oriented with respect to said surface of said disc at a variety of angles, whereby within the two groups of teeth, which point in general either upwardly or downwardly relative to said surface of said disc, adjacent teeth are inclined at varying angles relative to said surface of said disc.

2. The apparatus of claim 1 wherein the angular inclination between said teeth and said surface of said disc ranges from about 0 degrees to about 90 degrees.

3. The apparatus of claim 2 wherein said openings are varied in size.

4. The apparatus of claim 3 wherein adjacent openings are varied in size.

5. The apparatus of claim 7 wherein the edges of adjacent openings are varied in length.

6. The apparatus of claim 5 wherein said length of said edges ranges from about 25 percent of a radius from said attachment means to said peripheral edges to about 100 percent of said radius.

7. A material mixing apparatus, comprising:

(a) a rotatable shaft;

(b) one or more multiple discs being fixedly mounted with attachment means on said shaft for rotation therewith, said discs being mutually spaced and opposed, whereby a space is located therebetween, wherein each disc is provided with plural circumferentially spaced and radially aligned openings located on and extending through said disc, wherein each opening has first and second edges oppositely extending from said disc for conveying materials through said openings, wherein each disc is further provided with mixing teeth located along and extending from the peripheral edges of said disc, said mixing teeth extending in opposite directions, alternately above and below said surface of said disc, said teeth being angularly inclined with respect to said surface of said disc at a variety of angles, whereby within the two groups of teeth, which point in general either upwardly or downwardly relative to said surface of said disc, adjacent teeth are inclined at varying angles relative to said surface of said disc; wherein each disc has said first edges of said openings extending into said space, and wherein said second edges of said openings extend outwardly from said space, whereby material being mixed by said apparatus is conveyed from outside said space into said space when said shaft is rotated.

8. The apparatus of claim 7 wherein the angular inclination between said teeth and said surface of said disc ranges from about 0 degrees to about 90 degrees.

9. The apparatus of claim 8 wherein said openings are varied in size.

10. The apparatus of claim 9 wherein adjacent openings are varied in size.

11. The apparatus of claim 10 wherein the edges of adjacent openings are varied in length.

12. The apparatus of claim 11 wherein said length of said edges ranges from about 25 percent of a radius from said attachment means to said peripheral edges to about 100 percent of said radius.

13. A material mixing apparatus, comprising:

(a) first and second rotatable shafts, wherein said shafts are juxtaposed end to end and are contrarotatable;

(b) first and second discs, wherein said first disc has attachment means mounted on said first shaft, wherein said second disc has attachment means mounted on said second shaft, said discs being mutually spaced and opposed, whereby a space is defined therebetween, wherein each disc is provided with plural circumferentially spaced radially aligned openings located on and extending through said disc, wherein each opening has first and second edges oppositely extending from said disc for conveying materials through said openings, wherein each disc is further provided with mixing teeth located along and extending from peripheral edges of said disc, said mixing teeth extending in opposite directions, alternately above and below said disc, said teeth being angularly oriented with respect to said surface of said disc at a variety of angles, whereby within the two groups of teeth, which point in general either upwardly or downwardly relative to said surface of said disc, adjacent teeth are inclined at varying angles relative to said surface of said disc; wherein each disc has said first edges of said openings extend inwardly into said space, and wherein said second edges of said openings extend outwardly from said space, whereby material being mixed by said apparatus is conveyed from outside said space into said space when said shafts are contrarotated and whereby material being conveyed into said space by said first disc travels in an opposite direction to material being conveyed into said space by said second disc.

14. The apparatus of claim 13 wherein the angular inclination between said teeth and said surface of said disc range from about 0 degrees to about 90 degrees.

15. The apparatus of claim 14 wherein said openings are varied in size.

16. The apparatus of claim 15 wherein adjacent openings are varied in size.

17. The apparatus of claim 16 wherein the edges of adjacent openings are varied in length.

18. The apparatus of claim 17 wherein said length of said edges range from about 25 percent of a radius from said attachment means to said peripheral edges to about 100 percent of said radius.

* * * * *